US005468121A

United States Patent [19]

Stogner

[11] Patent Number: 5,468,121

[45] Date of Patent: Nov. 21, 1995

[54] APPARATUS AND METHOD FOR POSITIONING DRILL PIPE IN A MOUSEHOLE

[76] Inventor: Huey Stogner, P.O. Box 803, Houston, Tex. 77001

[21] Appl. No.: 193,260

[22] Filed: Feb. 8, 1994

[51] Int. Cl.[6] ..... E21B 19/00

[52] U.S. Cl. ..... 414/745.2; 166/77.51; 254/93 HP; 414/22.63

[58] Field of Search ..... 166/77.5, 85, 187; 414/745.2, 22.51, 22.63, 22.68, 22.69, 22.71; 254/93 HP

[56] References Cited

U.S. PATENT DOCUMENTS

| | | | |
|---|---|---|---|
| 2,321,245 | 6/1943 | Reed | 166/77.5 |
| 2,826,445 | 3/1958 | Tidland | 294/93 |
| 3,613,906 | 10/1971 | Deyo | 414/745.2 |
| 3,915,244 | 10/1975 | Brown | 175/85 |
| 4,044,895 | 8/1977 | Adair | 175/85 |
| 4,102,373 | 7/1978 | Winiasz | 254/93 HP |
| 4,252,215 | 2/1981 | Bell | 254/93 HP |
| 4,253,694 | 3/1981 | Walter et al. | 294/93 |
| 4,348,920 | 9/1982 | Boyadjieff | 81/57.25 |
| 4,455,116 | 6/1984 | Lindstedt et al. | 414/22 |
| 4,534,424 | 8/1985 | Ramsey | 166/77.5 |
| 4,738,321 | 4/1988 | Oliver | 414/22.68 |
| 4,765,401 | 8/1988 | Boyadjieff | 166/77.5 |
| 4,843,945 | 7/1989 | Dinsdale | 166/77.5 |

FOREIGN PATENT DOCUMENTS 9309330 5/1993 WIPO .

*Primary Examiner*—William E. Terrell
*Assistant Examiner*—Thomas J. Brahan
*Attorney, Agent, or Firm*—Sroufe, Payne & Lundeen

[57] ABSTRACT

An apparatus and method for positioning drill pipe within a mousehole are disclosed. The apparatus includes a lifting member positioned by an elevator disposed at a bottom end of a mousehole wherein the member abuts the pipe from beneath. The elevator can comprise an expandable bladder or a carriage lifted by a cable. By engaging the elevator, the position of the upper end of the pipe can be raised a sufficient degree above the top end of the mousehole to apply a pipe tool around the pipe upper end. In such a manner, the mousehole joint can be removed using a conventional pipe hoist rather than by connection to the kelly joint which might necessitate otherwise a cessation of drilling.

13 Claims, 4 Drawing Sheets

APPARATUS AND METHOD FOR POSITIONING DRILL PIPE IN A MOUSEHOLE

FIELD OF THE INVENTION

The present invention relates to an apparatus and method for positioning a joint of drill pipe within a mousehole, particularly to lift the upper end of the joint above the top end of the mousehole.

BACKGROUND OF THE INVENTION

In a well drilling operation, joints of drill pipe generally are added one after another to the upper end of the drill string. After the well has been drilled "kelly down," that is, the length of the kelly joint, the drill string is lifted, string supporting slips are placed in position and the kelly is disengaged from the string. A new joint of pipe is then inserted between the kelly and the string.

Spare drill pipe is typically stored on a horizontal pipe rack adjacent the rig platform except for the next joint to be used which is hoisted off the pipe rack and placed in a holding tube known as a "mousehole." The mousehole allows the next joint to be held in a vertical orientation suitable for ready attachment to the drill string. Since the kelly cannot generally be moved laterally for vertical positioning over the mousehole joint, the mousehole is typically positioned in close proximity to the wellbore and slanted at an angle which facilitates threaded connection to the kelly. The kelly is then manually positioned at an angle supplementary to that of the joint and lowered so that a threaded "pin" connection of the kelly stabs into a complementary threaded "box" connection of the joint. After the threads between the kelly and new joint are made up, the joint is lifted from the mousehole and inserted into the drill string so that drilling can resume.

Due to the proximity of the mousehole to the rotary table in many rigs, the upper end of the mousehole joint is preferably positioned close to the rig floor to avoid possible interference with drilling equipment on the platform. Alternatively, the upper end of the joint in the mousehole can be held in a rotary mousehole makeup tool which is generally installed in the rig sub-floor. Thus, a situation has evolved wherein a joint once lowered into the mousehole is difficult to position for makeup by means other than by connection to the kelly.

Occasionally, the mousehole joint is not inserted directly into the string, but is handled for some additional purpose or returned to the pipe rack (e.g. following the discovery of damaged threads). However, means for retrieving the joint from the mousehole without interrupting drilling operations (i.e. by breaking the kelly from the drill string) has generally been unavailable since the box end of the joint is difficult to access as mentioned above. This can present a time consuming problem because a substitute joint cannot be retrieved from the pipe rack until after a bad joint is removed from the mousehole.

Conventional mouseholes typically use a spring at the bottom of the mousehole to absorb the shock of a joint falling into the mousehole. However, the spring does not support a smaller or pup joint which is too short to span the distance from the upper end to the bottom. Accordingly, there is a need for an apparatus which can facilitate positioning, hoisting and removal of a joint of drill pipe from a mousehole without having to cease drilling operations.

SUMMARY OF THE INVENTION

A mousehole positioning apparatus of the present invention elevates an upper end of a joint of drill pipe above the top end of the mousehole to facilitate hoisting the joint therefrom using a pipe hoist instead of the kelly. In such a manner, the mousehole joint can be handled without the need for interrupting well drilling operations.

In one aspect, the present invention provides an apparatus for the positioning of drill pipe within a mousehole, the mousehole including a longitudinal cylindrical sleeve having an open top end adjacent a drilling rig floor and a bottom end depending therefrom. The apparatus includes a lifting member mountable in the mousehole having a surface for engaging a lower end of the pipe received in the mousehole. An elevator is provided for raising and lowering the lifting member with respect to the bottom end of the mousehole and elevating an upper end of the pipe with respect to the top end of the mousehole.

As one embodiment, the elevator includes an expandable bladder positionable between the lifting member and the bottom end of the mousehole. The expandable bladder preferably comprises a flexible tube shape having a foldable or corrugated side wall. A source of pressurized fluid controls the expansion of the expandable bladder. An actuator valve can control inflation and deflation of the expandable bladder and is typically operable in expansion, deflation or neutral modes. A relief valve can be used to vent the fluid from the expandable bladder when the pressure exceeds a preset value.

In another embodiment, the present invention provides an elevator comprising a carriage disposed at the bottom end of the mousehole and a hoist operatively associated with the carriage. The hoist includes a cable guided by a sheave mounted in the carriage. The cable is attached to an exterior surface adjacent the mousehole and is threaded through transverse openings, preferably vertical slits therein.

In another aspect of the invention, a method for positioning drill pipe in a mousehole Comprises the steps of: (a) installing a drill pipe positioning apparatus comprising the above-described lifting member and elevator into the bottom end of a mousehole; (b) placing the drill pipe into the mousehole so that the lower end of the pipe rests on the member; and (c) raising the elevator to a suitable height.

The elevator controllably positions the lifting member which, in turn, positions the upper end of the pipe above the top end of the mousehole allowing a pipe tool to be secured to the upper end of the pipe in the mousehole.

DETAILED DESCRIPTION OF THE INVENTION

Figure 1:
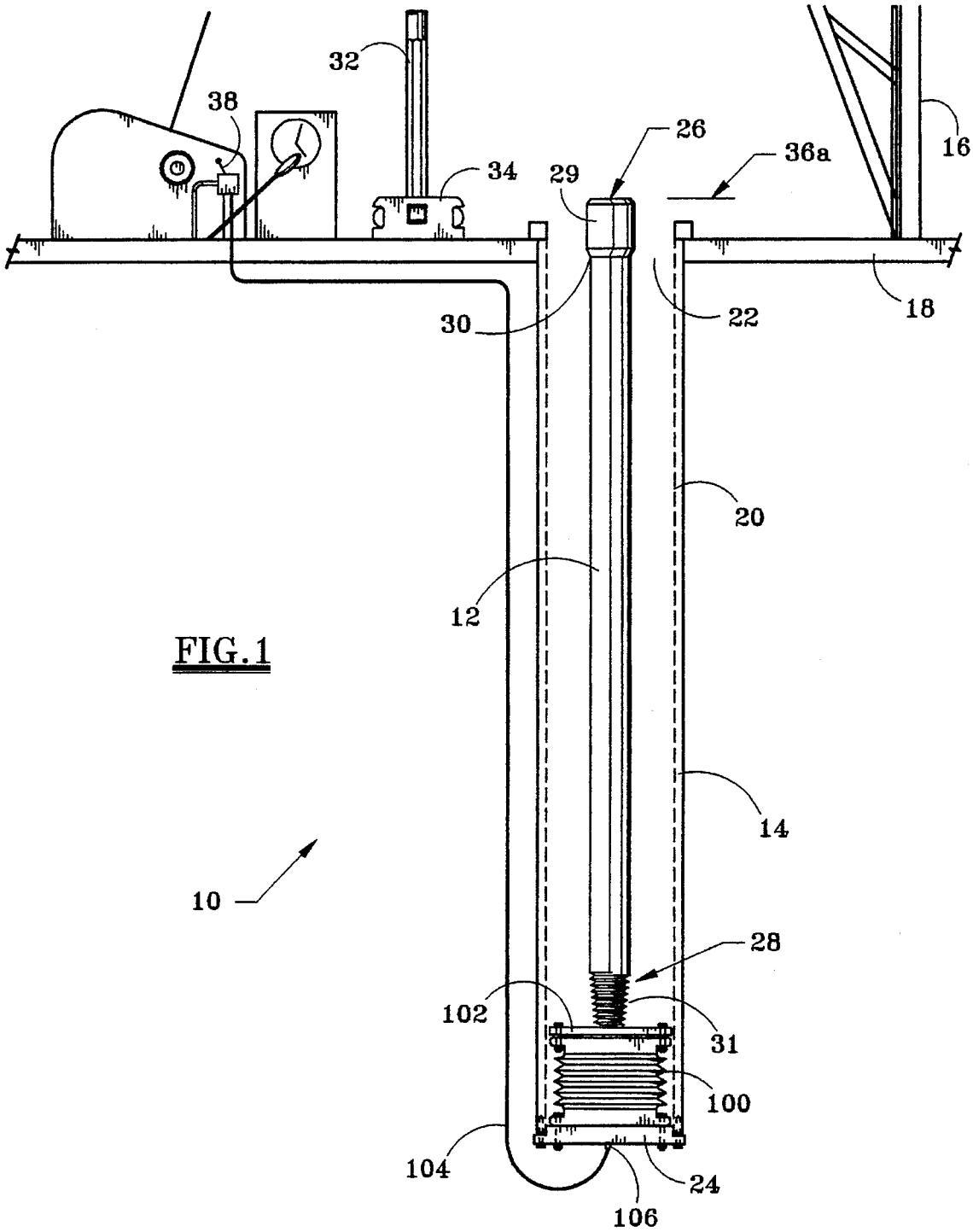
FIG. 1 is a representational elevation view of one embodiment of a mousehole drill pipe positioning apparatus of the present invention wherein the apparatus comprises an expandable bladder positioned beneath the pipe and shown in an unexpanded state.

Referring to FIGS. 1–8 wherein like numerals reference like parts, a mousehole drill pipe positioning apparatus 10 of the present invention is suitable for adjusting the elevation of a joint of drill pipe 12 disposed in a mousehole 14 of a drilling rig 16 with respect to a rig floor 18. Operation of the apparatus 10 facilitates hoisting the joint 12 from the mousehole 14 by a drill pipe hoist (not shown).

As is well known in the art, the mousehole 14 comprises a longitudinally oriented sleeve 20 depending from the rig floor 18. The sleeve 20 includes an open top end 22, a closed bottom end 24, and a wall 25. The joint 12 which is received in the sleeve 20 during a drilling operation for temporary storage thereof, includes an upper end 26 and a lower end 28. The upper end 26 has a female threaded box connection 29 forming a neck 30 suitable for engaging a hoist cable and the lower end 28 has a male complimentary threaded pin connection 31.

As mentioned previously, the joint 12 is ordinarily positioned in the sleeve 20 so that the upper end 26 is located adjacent the top end 22 of the mousehole 14 in close proximity to the rig floor 18. The position of the upper end 26 with respect to the rig floor 18 defines an extension 36*a* which in ordinary drilling operations is suitable for facilitating connection to a kelly joint 32 yet avoids interference with the kelly 32, a rotary table 34, and other equipment associated with a drill string (not shown). On the other hand, the extension 36*a* is generally unsuitable for allowing easy access to the neck 30 of the box 29 for attaching a cable of a pipe hoist. Heretofore, the only convenient means for removing the mousehole joint 12 from the mousehole 14 is by conventional attachment to the kelly joint 32.

Figure 2:
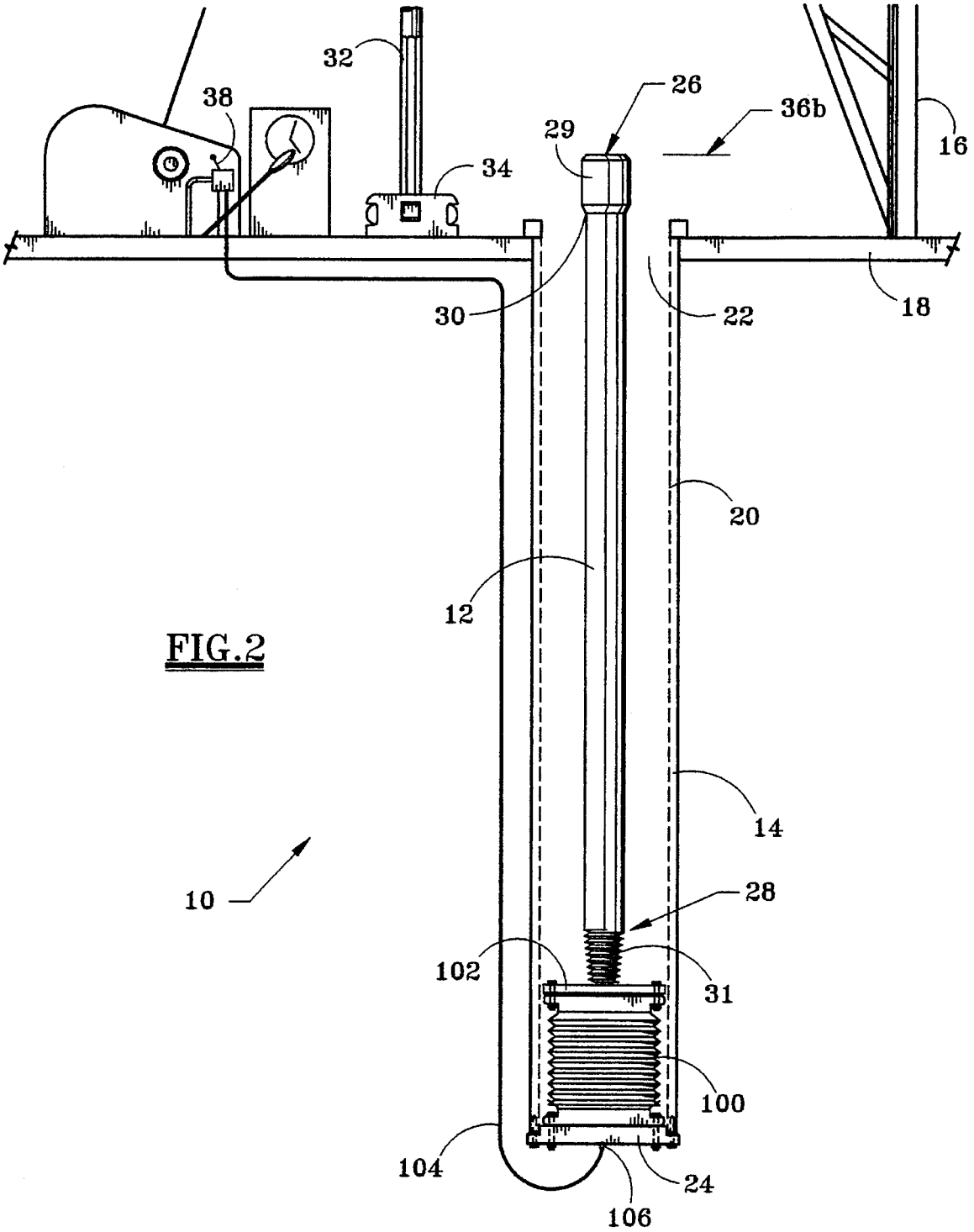
FIG. 2 is a representational elevation view of the embodiment of FIG. 1 showing the bladder in an expanded state.

In the practice of the present invention, activation of the pipe positioning apparatus 10 elevates the pipe upper end 26 with respect to the floor 18 to define a pipe extension 36*b* as seen in FIG. 2. The pipe extension 36*b* has a sufficiently greater length than the extension 36*a* to provide easy access to the pipe neck 30 for attaching the hoist cable and removing the joint 12 from the mousehole 14 using the pipe hoist.

As seen in FIGS. 1–4, the pipe elevator apparatus 10 can comprise an expandable bladder 100 located at the bottom end 24 of the mousehole 14. The bladder 100 has a plate 102 and an optional spring 90 and top plate 92 for engaging the lower end 28 of the joint 12. The bladder 100 is preferably made of a tough, flexible material such as rubber which can be inflated using a suitable gas such as pressurized air or nitrogen.

The specific design of the rubber bladder 100 follows the function thereof. One convenient design is a tube or barrel shape having a folded or corrugated side wall 103 which upon inflation expands axially to increase the longitudinal dimension of the bladder 100 and, in turn, elevate the position of the plate 102 with respect to the bottom end 24 of the mousehole 14.

The bladder 100 can be connected by a conventional tubing 104 and tube fitting 106 to a source of pressurized air (not shown). The pressurized air source can be engaged by action of an actuator valve (not shown) as well known in the art. The actuator valve can be operated between three different modes including inflation, deflation and neutral by a hand operated lever 38, for example. The bladder 100 can be deflated and reduced in longitudinal dimension by connection via the air access tube 104 to a lower pressure source including a vacuum source to evacuate at least a portion of the air in the bladder 100. The bladder 100 preferably has a pressure relief device (not shown) to prevent overpressure thereof.

Figure 3:
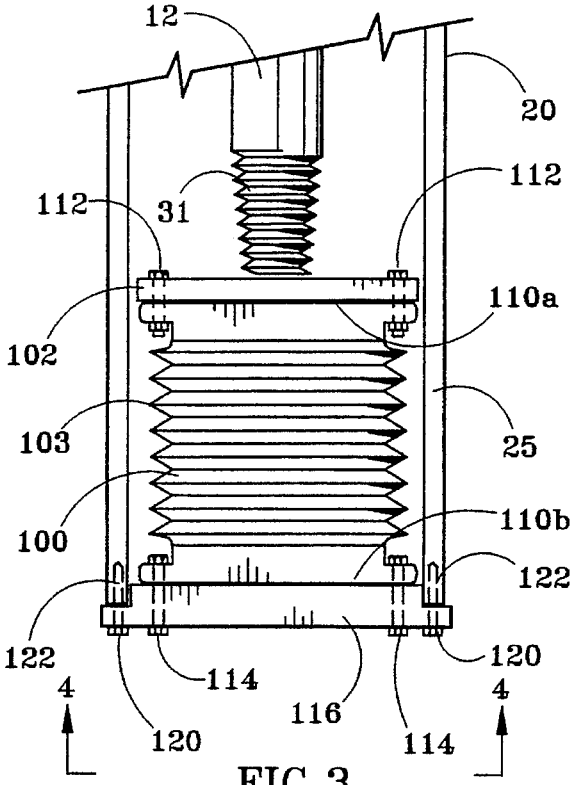
FIG. 3 is an exploded, partially cut-away side view of the embodiment of FIG. 1 showing the expandable bladder mounted at the bottom of the mousehole.
Figure 4:
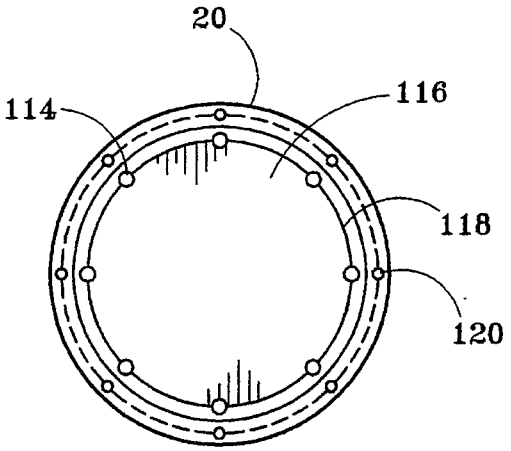
FIG. 4 is a bottom view of the mousehole sleeve of FIG. 3 taken along the lines 4—4.
Figure 7:
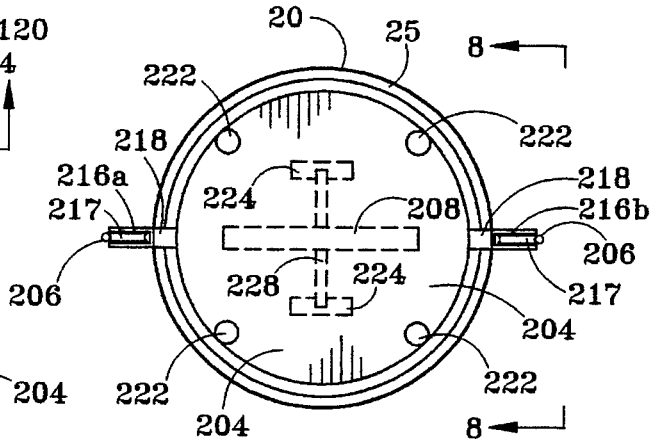
FIG. 7 is a top cross-sectional view of the elevator carriage of the embodiment of FIG. 5 showing a carriage top plate.
Figure 8:
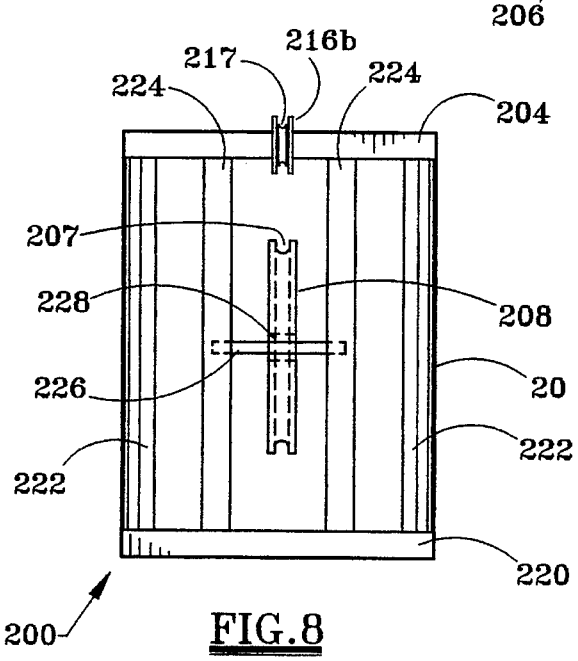
FIG. 8 is a side view of the elevator carriage of the embodiment of FIG. 5 along the lines 8—8 showing a mounted sheave.
Figure 6:
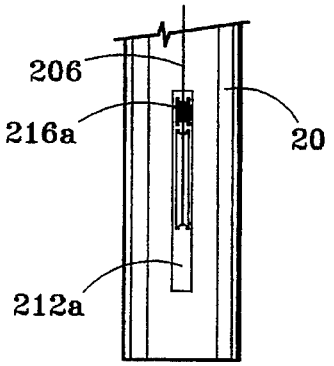
FIG. 6 a partial side view of the mousehole sleeve of the embodiment of FIG. 5 showing a side slit for attachment of a pulley/cable assembly.
Figure 5:
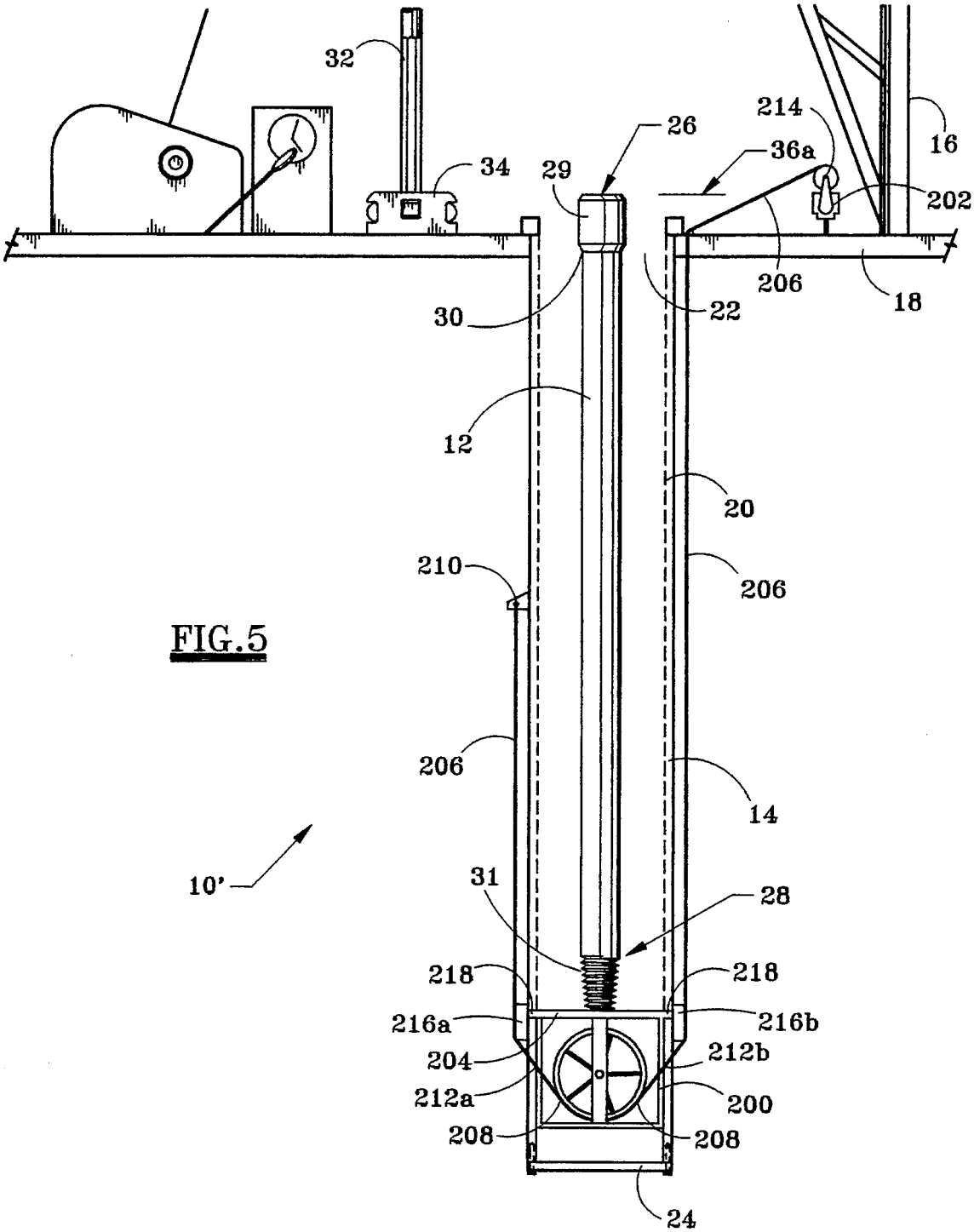
FIG. 5 is a representational elevation view of an alternative embodiment of the mousehole drill pipe positioning apparatus of the present invention wherein the apparatus comprises an elevator carriage operatively engaged by a cable attached to an air hoist and mounted at the bottom of a mousehole sleeve.

To install the elevator 10 in the mousehole 14, the expandable bladder 100, as seen in FIGS. 3–4, can be conveniently bolted at the bottom of sleeve 20. The bladder 100 preferably has upper and lower flange surfaces 110*a*, 110*b*. The top flange 110*a* is attached by bolts 112, for example, to the top plate 102 having a matching flange surface. The bottom flange 110*b* is attached by bolts 114 to a cover 116 having a matching flange surface 118 and forming the bottom of the mousehole 14. The bottom cover 116 is, in turn, preferably secured to the bottom of the sleeve 20 by bolts 120 received in holes 122 formed in the sleeve wall 25.

In an alternate embodiment seen in FIGS. 5–8, an elevator apparatus 10' can comprise a carriage 200 disposed adjacent the bottom end 24 of the mousehole 14 which is operatively engaged by a hoist 202. The carriage 200 has an upper plate 204 (optionally with a shock absorbing spring, not shown) for engaging the lower end 28 of the joint 12. The hoist 202 includes a cable 206 guided in a groove 207 of a sheave 208 mounted in the carriage 200. The cable 206 is typically secured at one end to an outer surface of the sleeve 20 by means such as a pad eye 210 and looped through parallel slits 212*a*, 212*b* formed longitudinally on opposite sides in the sleeve 20 for engagement with the sheave 208. The other end of the cable is then attached to a reel 214 of the hoist 202 which can be air or hydraulically powered, for example. Pulleys 216*a*, 216*b* for engaging the cable 206 from opposite sides of the sleeve 20 have a wheel 217 and are preferably exteriorly mounted on the outer ends of arms 218 extending radially outwardly from the upper plate 204 through the slits 212*a*, 212*b*. Thus, the pulleys 216*a*, 216*b* promote slidable engagement of the carriage 200 on the cable 206 within the mousehole 14.

The carriage 200 includes a lower plate 220 attached to the upper plate 204 by a plurality of vertical support struts 222. A pair of additional struts 224 secure a shaft 226 operatively associated with the sheave 208. The sheave 208 generally has an internally mounted bearing 228 and rotates on the shaft 226.

When it is desired to elevate the joint 12 for raising the upper end 26 above the rig floor 16, the hoist 202 is activated to draw in or shorten the cable 206 and, in turn, elevate the carriage 200 within the mousehole 14. It is understood that the maximum elevation height will depend on the length of the slits 212*a*, 212*b*, length of the cable 206 and position of the pad eye 210.

In accordance with the practice of the present invention, the present pipe elevator 10 or 10' is positioned at the bottom end 24 of the mousehole 14. A joint of drill pipe 12 is lowered into the mousehole 14 using a conventional pipe hoist (not shown) available at the rig 16 so that the lower end 28 rests on the elevator 10 or 10'. When it is desired to replace the mousehole joint 12 without disengaging the kelly 32 from the drill string, the elevator 10 or 10' is raised a sufficient height in the mousehole 14 for positioning of the pipe upper end 26 above the mousehole top end 22 and allowing a pipe tool (e.g. cable) to be secured to the neck 29 of the joint 12.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

I claim:

1. An apparatus for positioning drill pipe in a mousehole including a longitudinal cylindrical sleeve having an open top end adjacent a drilling rig floor and a bottom end depending therefrom, comprising:

a lifting member mountable in the mousehole having a surface for engaging a lower ,end of a drill pipe received in the mousehole; and an elevator for raising and lowering the lifting member with respect to the bottom end of the mousehole to elevate an upper end of the drill pipe with respect to the top end of the mousehole.

2. The apparatus of claim 1, wherein the elevator includes an expandable bladder positionable between the member and the bottom end of the mousehole.

3. The apparatus of claim 2, wherein the expandable bladder comprises a flexible tube shape having a corrugated side wall.

4. The apparatus of claim 2, including a source of pressurized fluid for expanding the expandable bladder.

5. The apparatus of claim 4, including an actuator valve for controlling inflation and deflation of the expandable bladder.

6. The apparatus of claim 5, wherein the actuator valve is selectively operable in expansion, deflation and neutral modes.

7. The apparatus of claim 2, comprising a relief valve for venting the fluid from the expandable bladder when the fluid in the bladder exceeds a preset pressure.

8. The apparatus of claim 1 wherein the elevator comprises:

a carriage disposed adjacent the bottom end of the mousehole; and a hoist operatively associated with the carriage.

9. The apparatus of claim 8, wherein the hoist includes a cable guided by a sheave mounted in the carriage.

10. The apparatus of claim 9, wherein the cable is attached to an exterior surface of the mousehole and is threaded through longitudinal slits therein.

11. A method for positioning drill pipe in a mousehole, comprising the steps of:

(a) installing a drill pipe positioning apparatus comprising a lifting member and elevator into the bottom end of a mousehole;

(b) placing drill pipe into the mousehole so that the lower end of the drill pipe rests on the lifting member; and (c) raising the elevator to a suitable height.

12. The method of claim 11, wherein the elevator controllably positions the member.

13. The method of claim 11, wherein the lifting member positions the upper end of the drill pipe above the top end of the mousehole allowing a pipe tool to be secured to the upper end of the drill pipe in the mousehole.

* * * * *

UNITED STATES PATENT AND TRADEMARK OFFICE

CERTIFICATE OF CORRECTION

PATENT NO. : 5,468,121

DATED : November 21, 1995

INVENTOR(S) : Huey Stogner

It is certified that error appears in the above-indentified patent and that said Letters Patent is hereby corrected as shown below:

Drawing:

In the drawings, Sheet 2, Fig. 2, a spring 90 should be shown above the plate 102, and a top plate 92 should be shown above the spring 90 and below the threaded pin connection 31.

In column 2, line 39, change "Comprises" to --comprises--.

In column 4, line 60, change "rig floor 16" to --rig floor 18--.

In claim 1, column 5, line 23, change "lower,end" to --lower end--.

Signed and Sealed this

Ninth Day of April, 1996

*Attest:*

*Attesting Officer*

BRUCE LEHMAN

*Commissioner of Patents and Trademarks*